US005271469A

United States Patent [19]

Brooks et al.

[11] Patent Number: 5,271,469

[45] Date of Patent: Dec. 21, 1993

[54] BOREHOLE STRESSED PACKER INFLATION SYSTEM

[75] Inventors: Robert T. Brooks, Houston; Edward T. Wood, Kingwood, both of Tex.

[73] Assignee: CTC International, Houston, Tex.

[21] Appl. No.: 865,188

[22] Filed: Apr. 8, 1992

[51] Int. Cl.[5] ..... E21B 33/127

[52] U.S. Cl. ..... 166/387; 166/187; 166/250; 166/292; 175/50; 73/151

[58] Field of Search ..... 166/387, 250, 292, 187; 175/40, 50; 73/151, 152

[56] References Cited

U.S. PATENT DOCUMENTS

Re. 30,711 8/1981 Suman, Jr. ..... 166/187 X

Re. 32,345 2/1987 Wood ..... 166/187 X 4,619,323 10/1986 Gidley ..... 166/285

*Primary Examiner*—Terry L. Melius

*Attorney, Agent, or Firm*—Donald H. Fidler

[57] ABSTRACT

A method for determining a proper inflation pressure for an elongated inflatable packer to effect a positive contact stress seal of an elastomer packer element with a borehole wall in a wellbore traversing earth formations. The temperature differential for each layer in a radial plane is determined. The final contact stress, the finite inflation pressure required to inflate the packer element and the temperature differential are functionally interrelated to one another to obtain a final contact stress or the packer element with a borehole wall.

19 Claims, 5 Drawing Sheets

BOREHOLE STRESSED PACKER INFLATION SYSTEM

FIELD OF THE INVENTION

This invention relates to a method for utilizing an inflatable packer in a wellbore in situations where liquid circulation in the wellbore disturbs normal in-situ temperatures along the wellbore as a function of depth and where the disturbed temperatures are offset or different relative to a normal in-situ temperature profile of the wellbore as a function of depth when the wellbore is in a quiescent undisturbed state. In particular, by use of temperature data of the environmental elements as taken in a horizontal radial plane in a wellbore where an inflatable packer will be set, inflation pressure of a packer element relative to contact sealing forces can be determined to that the integrity of the seal of such inflated packer element will be positive when the environmental elements of the wellbore return to a quiescent or undisturbed in-situ temperature state.

BACKGROUND OF THE INVENTION

In drilling a borehole, the borehole can have the same general diameter from the ground surface to total depth (TD). However, most boreholes have an upper section with a relatively large diameter extending from the earth's surface to a first depth point. After the upper section is drilled a tubular steel pipe is located in the upper section. The annulus between the steel pipe and the upper section of the borehole is filled with liquid cement which subsequently sets or hardens in the annulus and supports the liner in place in the borehole.

After the cementing operation is completed, any cement left in the pipe is usually drilled out. The first steel pipe extending from the earth's surface through the upper section is called "surface casing". Thereafter, another section or depth of borehole with a smaller diameter is drilled to the next desired depth and a steel pipe located in the drilled section of borehole. While the steel pipe can extend from the earth's surface to the total depth (TD) of the borehole, it is also common to hang the upper end of a steel pipe by means of a liner hanger in the lower end of the next above steel pipe. The second and additional lengths of pipe in a borehole are sometimes referred to as "liner".

After hanging a liner in a drilled section of borehole, the liner is cemented in the borehole, i.e. the annulus between the liner and the borehole is filled with liquid cement which thereafter hardens to support the liner and provide a fluid seal with respect to the liner and also with respect to the borehole. Liners can be installed in successive drilled depth intervals of a wellbore, each with smaller diameters, and each cemented in place. In any instance where a liner is suspended in a wellbore, there are sections of the casing and of the liner and of adjacent liner sections which are coextensive with another. Figuratively speaking, a wellbore has telescopically arranged tubular members (liners), each cemented in place in the borehole. Between the lower end of an upper liner and the upper end of a lower liner there is an overlapping of the upper and lower liners and cement is located in the overlap sections.

After the liners have been located through the strata of interest, the well if completed. In the completion of a well using a compression type packer, typically a production tubing with a compression type production packer is lowered into the wellbore and disposed or located in a liner just above the formations containing hydrocarbons. The production packer has an elastomer packer element which is axially compressed to expand radially and seal off the cross-section of the wellbore by virtue of the compressive forces in the packer element. Next, a perforating device is positioned in the liner below the packer at the strata of interest. The perforating device is used to develop perforations through the liner which extend into cemented annulus between the liner and the earth formations. Thereafter, hydrocarbons from the formations are produced into the wellbore through the perforations and through the production tubing to the earth's surface. Typically in the production of hydrocarbons there is a pressure differential across the packer element and heat energy is applied to the packer element. The heat energy comes from downhole temperature conditions of the hydrocarbons which are higher than ground surface temperature conditions.

In summary, packer element of a compresion packer used in the well completion is composed of rubber or an elastomer product which is highly compressed to span the annular gap between the liner and the production tubing and is compressed to exert sufficient contact pressure with the wellbore to provide a fluid tight seal. In time, the downhole temperature and differential pressure across the packer element can cause the packer element to deteriorate and consequently to leak.

In other instances in the life of a production well, gas migration or leakage is a particularly significant problem which can occur when fluids migrate along the cemented overlapped sections of a liner and borehole. Any downhole fluid leak outside the production system is undesirable and requires a remedial operation to prevent the leak from continuing.

Some completions use an inflatable packer in preference to a compressive packer. Some operators also prefer to use an inflatable packer to isolate areas of a wellbore where fluid leaks occur.

An inflatable packer typically includes an annular elastomer element (up to about 40 feet in length) on a central steel tubular member which extends therethrough. In use, the inflatable packer is disposed in a borehole on a string of production pipe and is located at the desired location in a borehole. The packer element is adapted to receive a cement slurry or a liquid ("mud") under pressure to inflate and to compress the packer element between the inflation liquid and the wellbore. A valving system in the packer is used to access the cement slurry or mud under pressure in the attached string of tubing to the interior of the elastomer packer element. The inflating pressure of the inflating liquid medium must be such that after the inflating pressure as trapped in the packer element, the packer element maintains a positive seal with respect to the borehole wall. A positive seal is a pressure of the packer element which exceed the pressure in the formations in the wellbore. Inflatable packers seal extremely well in open boreholes.

Heretofore, use of an inflatable packer to provide a gas tight seal in a smooth walled liner to bypass fluid leaks has not been reliable because there has been no reliable way to determine what the inflation pressure for the packer should be in order to obtain the desired packer seal in a liner. Too much pressure in an inflatable packer can overstress a liner or burst the inflatable packer element while too little pressure will not provide a proper packer seal. In some instances, even a fully inflated packer element at maximum inflation pressure will not obtain a gas tight seal in a liner.

In another form of well completion, in hard earth formations, inflatable packers on a production string of pipe can be spaced apart by a section of pipe and inflated to straddle a production zone so that a liner is not required. Such a process is described in U.S. Pat. No. 4,440,225 issued Apr. 3, 1984. U.S. Pat. No. 4,440,225 recognizes that a cement inflated packer can leak under pressure because cement shrinkage in the packer, upon curing, can produce a micro-annulus gap which permits fluid migration. The solution in the patent for cement shrinkage is to algebraically sum the radial elastic compression of the mandrel, the radial elastic compression of the packer element and the radial elastic compression of the formation so that this sum exceeds the radial shrinkage of the cement element upon curing by an amount sufficient that the sealing pressure exceeds the formation pore pressure after the cement is set or cured.

In the present state of technology, it has been discovered that the '225 patent method sometimes overstresses the earth formations and can sometimes result in gas leaks. While having great utility, the method lacks preciseness in predetermining the effectiveness of an inflatable packer seal. Also, the method does not deal with completions where the inflation diameter of an inflatable packer used in a borehole extending below a liner is a factor in the operations.

During and after a well completion, some well operations such as acidizing or fracturing develop a downhole temperature effect on the wellbore elements and can cause fluid leakage.

The net effect of a considerable number of wellbore completion and remedial operations is to temporarily change the temperatures along the wellbore from a normal in-situ temperature condition along the wellbore. At any given level in a wellbore, the temperature change may be an increase or decrease of the temperature condition relative to the normal in-situ temperature depending upon the operations conducted.

What happens then is that an inflatable well packer, which includes metal elastomer and an inflation liquid is normally set in a stressed condition in a metal liner or overlapped sections of liners, which are at a different temperature condition than the normal in-situ temperature conditions. After the operations are concluded and the wellbore returns to its normal in-situ temperature, this change in temperature changes the dimensions of the well packer which affects the stressed condition of the packer. In the case of a cement filled packer, the decrease in volume when the cement cures also affects the stressed condition. These changes in temperature and cement volume can reduce the stressed condition of the packer to a failure mode where the packer leaks after the temperature returns to an in-situ temperature condition.

SUMMARY OF THE PRESENT INVENTION

In the present invention, it is recognized for the first time that the temperature effects in a wellbore disturbed by drilling or other fluid transfer mechanisms in a wellbore can significantly affect the downhole sealing efficiency of an inflatable packer when the borehole temperatures reconvert to an in-situ undisturbed temperature condition or to operational conditions of the well.

In a packing system which includes the use of an inflatable packer in a wellbore, the packer provides more or less concentric layers which include an inner layer of the packer tubular element, layer of cement element and a layer of an elastomer sealing element which, in a simple system, engages the wall of the wellbore. The packing system also includes the surrounding rock formations. In more complex systems, the wellbore can further be provided with additional nested liner elements and cement elements extending radially outward from a central axis of the borehole and are more or less concentrically arranged.

In the present invention, the temperature profile of the wellbore is determined for an undisturbed in-situ state and for the disturbed state prior to use of an inflatable packer. Then at the desired depth location for the inflatable packer and in a horizontal plane, the temperature difference between the disturbed state and undisturbed state of each layer is determined.

Next, the intended inflation pressure for the inflatable packer is selected and utilized with the temperature differences between disturbed borehole temperatures and undisturbed borehole temperatures in equations for the elastic strain and radial displacement for each of the layers using known borehole and drilling parameters to ascertain and obtain a positive contact stress of the elastomer element with the wall of the borehole after the borehole returns to undisturbed in-situ temperatures.

Alternatively, the desired contact stress with a borehole can be selected and utilized with the temperature difference between disturbed borehole temperatures and disturbed borehole temperatures in the equations for elastic strain and radial displacement for each of the layers using known borehole and drilling parameters to ascertain the inflation pressure necessary in an inflatable packer to obtain the desired contact stresses.

Alternately, for a desired contact stress with a borehole and a selected inflation pressure it can be determined what temperature differential is required to obtain the desired contact stress. Then the temperature of the packer system can be adjusted to produce the necessary operation differences.

In still another aspect of the invention, the proportioning of the packer element necessary to obatin a positive seal can be determined by use of the method of the present invention.

A general form of the strain equation for radial displacement of a layer element is $$\mu(R) = \frac{A}{R}\int_{R_1}^{R_0} \Delta TRdR + \frac{C_1}{R} + \frac{C_2}{R}$$

and for radial stress (or pressure) is $$\sigma(R) = \frac{X}{R_2}\int_{R_0}^{R_1} \Delta TRdR + YC_1 - \frac{Z}{C_2}$$

where the symbols A, X, Y and Z are established parameter values for the materials of the layer, R is a radius value, ΔT is the temperature difference between the disturbed state and the undisturbed state at the location for the layer in question.

In its simplest form, a wellbore packing system comprises an inflatable packer in an initial inflated condition in the wellbore and the surrounding rock formation. It therefore includes a layer of steel (packer mandrel) a fluid slurry layer of cement, a layer of elastomer and the surrounding rock formation.

The layers are at successively greater radial distances from the centerline of the borehole in a horizontal plane and have wall thicknesses defined between inner and outer radii from a center line.

Because completion operations in the wellbore alter temperatures along the length of the wellbore, the temperatures of various layers located below a given crossover depth in the wellbore will be below the normal temperatures of the various layers after the wellbore returns to an undisturbed temperature. Above the given crossover depth in the wellbore, the temperatures of the various layers will be higher than the normal temperatures after the wellbore returns to an undisturbed temperature. When the packer is in the wellbore, the temperature of the liquid cement slurry is introduced at a lower temperature than the temperature of the rock formation and also lower than any mud or control liquid in the wellbore.

After the packer element is inflated, in the initial condition of the inflated packer, the cement slurry under pressure induces a certain strain energy in each of the more or less concentrically, radially spaced layers of steel, cement, elastomer and rock. Strain energy is basically defined as the mechanical energy stored up in stressed material. Stress within the elastic limit is implied; therefore, the strain energy is equal to the work done by the external forces in producing the stress and is recoverable. Stated more generally, strain energy is the applied force and displacement including change in radial thickness of the layers of the packing system under the applied pressure.

When the inflation pressure is trapped at a fixed pressure in the inflatable packer, the liquid cement slurry cures and converts to a solid layer of cement. The solid layer of cement has a reduced wall thickness compared to the liquid cement slurry because of the volumetric shrinkage of the cement. This results in a packer condition where the cured cement layer loses some of its strain energy which decreases the overall strain energy of the packing layer system and reduces the contact sealing force of the packer element with the borehole wall. However, in time, the wellbore temperature will increase (or decrease) after the packer to the in-situ undisturbed temperature which will principally increase (or decrease) the strain energy in the packer element which reestablishes an increased (or decreased) overall strain energy of the packing layer system.

The purpose of the invention is to determine the contact sealing forces, giving effect to the change in temperatures and the cement shrinkage, as a function of inflation pressure.

In practice then, in the present invention the contact stress on the borehole wall by the elastomer layer can be predetermined and the wall thicknesses of the layers can be optimized by preselection to obtain predicted contact stress in a wellbore as a function of inflation pressure and the utility of a packer to obtain a desired result can be predetermined.

DESCRIPTION OF THE PRESENT INVENTION

Figure 1:
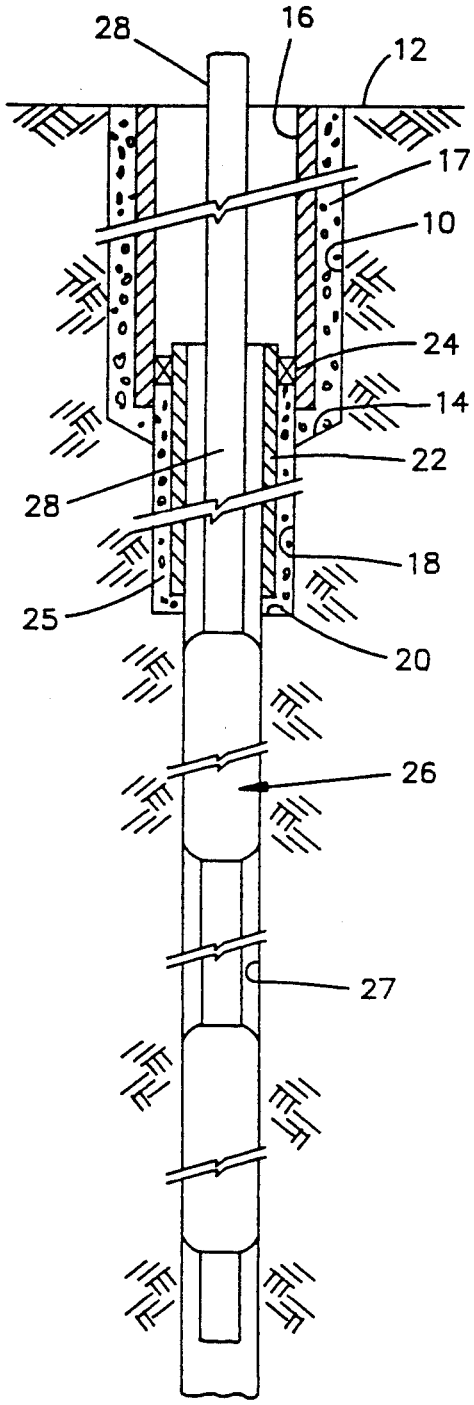
FIG. 1 is a vertical sectional view of a wellbore in which an inflatable straddle packer is installed.

Referring now to FIG. 1, a wellbore is schematically illustrated with a borehole section 10 extending from the ground surface 12 to a first depth point 14 and with a tubular metal casing 16 cemented in place by an annulus of cement 17. An adjacent borehole section 18 extends from the first depth point 14 to a lower depth point 20. A tubular metal liner 22 is hung by a conventional liner hanger 24 in the lower end of the casing 16 and is cemented in place with an annulus of cement 25. An adjacent borehole section 27 extends from the depth point 20 to a lower bottom at the Total Depth "TD" (not shown in FIG. 1). The borehole section 27 goes through earth formations and a inflatable straddle packer 26 (which typically comprises a pair of inflatable packers mounted in a longitudinally spaced relationship on a single mandrel) is connected by a production tubing 28 to the earth's surface.

In a drilling of borehole sections and in the cementing operations, liquids are circulated in the borehole which change the in-situ undisturbed temperatures along the length of the borehole as a function of time and circulation rate. The change in temperatures will be discussed later in more detail.

In another type of completion in lieu of a straddle packer, a single inflatable packer can be utilized with a perforating gun to produce fluids through the packer a system such as shown in U.S. Pat. No. 3,918,522 (U.S. Pat. No. Re. 30,711).

For various reasons it may be desirable to utilize an single inflatable packer or straddle inflatable packer in either an open borehole section or in a liner.

Figure 2:
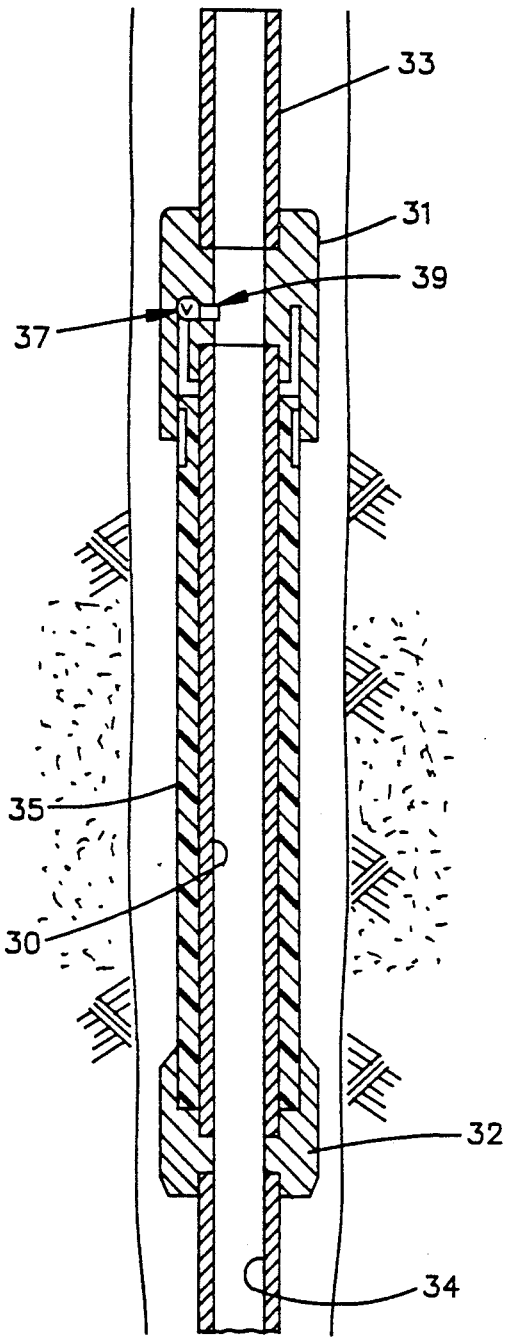
FIG. 2 is a fragmentary section view of a wellbore and showing in cross-section an inflatable packer suspended from a tubing string in the wellbore.

For background information, a typical inflatable packer as schematically shown in FIG. 2 consists of a central tubular steel member or mandrel 30 which is coupled to upper and lower subs 31, 32 where the upper sub connects to a string of pipe or tubing 33 and the lower sub 32 connects to an extension pipe 34. Normally a plug seat (not shown) is located below the packer to retain pressure for inflating the packer element. A tubular elastomer packer element 35 coextensively extends along the mandrel 30 in sleeved relation thereto and is attached to the upper and lower subs 31 and 32. The upper sub 31 has a valve system 37 which controls access of liquid to the interior of the packer element 35 between the mandrel 30 and the inner wall of the packer element 35. The valve system usually has a knock off plug or valve control 39 which is activated to admit liquid to the interior of the packer member 35 when a plug is seated in the plug seat at lower end of the mandrel 30. Usually the liquid is required to have a preselected threshold pressure to commence inflation of the packer element 35. Anti-extension or reinforcing elements 36 are located in the end well of the packer element for bridging support when the packer element is inflated.

Figure 3:
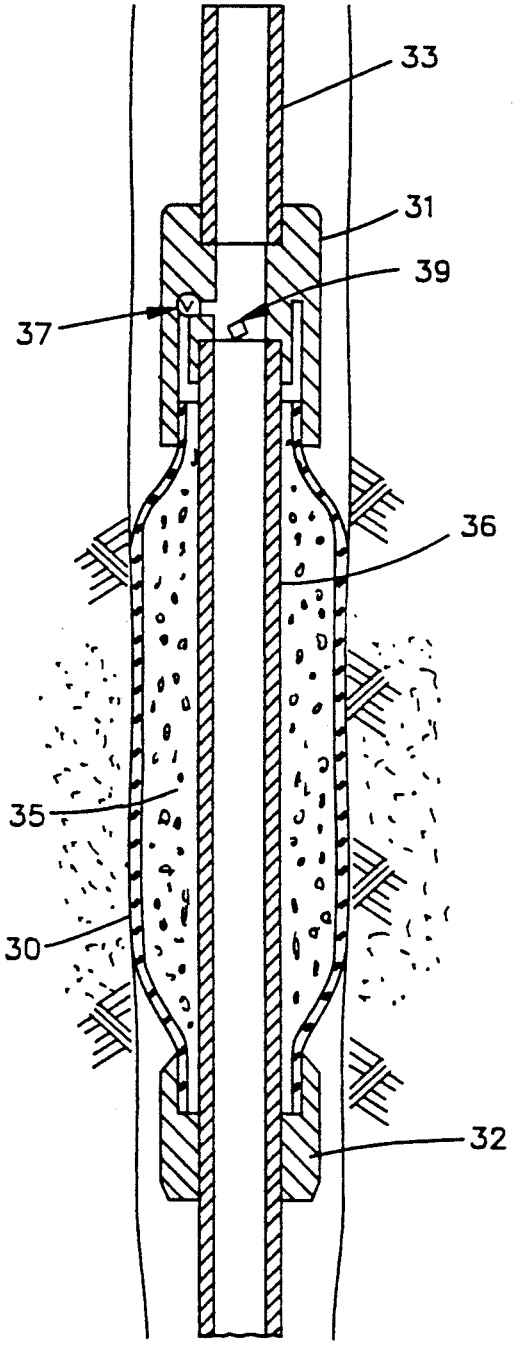
FIG. 3 is a view similar to FIG. 2 but showing the packer in its inflated sealing condition.

After the desired inflation occurs and the packer element is inflated as shown in FIG. 3, the valve system 37 traps the pressurized liquid at its final inflation pressure in the interior of the packer element 35. The inflating liquid is usually a cement slurry which after inflation, cures and hardens into a solid but mud inflation liquids are also used. In the process of curing of cement, heat is generated and upon curing, the volume of cement shrinks. The elastomer element 35 is under compression to maintain a seal with respect to the borehole wall. Excess cement is reversed out or drilled out in a conventional manner.

A typical length for a packer member includes lengths up to forty feet. Further details and features of inflatable packers is shown and described in U.S. Pat. No. 4,420,159 (U.S. Pat. No. Re. 32,345).

Figure 14:
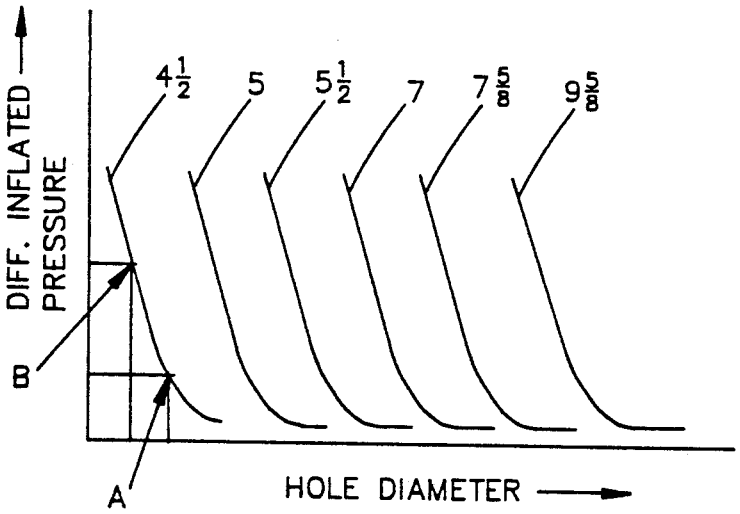
FIG. 14 is a schematic plot of various sizes or inflatable packers to illustrate the expansion characteristics as a function of differential inflation pressure.

In the case of an inflatable packer, the O. D. of the uninflated packer relative to the I.D. of the liner is a factor in determining the inflation pressure limits. Typically a clearance gap of ⅜" to ½" exists between the I.D. of the liner and the O.D. of the packer. Thus the smallest I.D. in a liner controls the size of the packer however, the wellbore diameter where the packer is inflated below the liner can be considerably larger in diameter. Inflatable packers can be inflated to up to five times their un-inflated diameter. However, as the diameter of a wellbore increases relative to a given size of well packer, the amount of differential inflation pressure that can safely be used will decrease. This is illustrated in FIG. 14 for various sizes of inflatable packages. As an example in FIG. 14, a 4½" O. D. packer can be used in a 10" I.D. wellbore below a liner but the inflation pressure as shown at point A in FIG. 14 will be kept low to avoid rupture of the packer so that wall contact pressure will be low. Conversely, such a 4½ O.D. packer when placed in a 6" I.D. well hole below a liner can utilize substantially higher inflation pressures (as shown at point B in FIG. 14) without rupture. In the two cases described, the contact sealing pressure will be substantially different. Acceptable contact sealing pressures between the inflated packer and wellbore are generally about 500 psi above pore (formation) pressure in open hole wellbores and about 1000 psi above pore pressure in cased wellbores. The object therefore is to inflate a packer with a safe differential inflation pressure and to obtain adequate contact sealing pressures.

In selecting an optimum differential inflation pressure for an inflatable packer, in most instances, a consideration must be made of one or more of the following factors:

1) fracture Pressure of the formation when in a hard rock formation;

2) break down pressure of the formation when in a soft rock formations;

3) internal yield pressure of the outermost liner for packer installations inside a liner;

4) internal yield pressure of the innermost liner (normally most critical near the surface);

5) collapse pressures of the liner or liners and the packer mandrel (normally most critical in the packer mandrel);

6) maximum recommended "Differential Inflation Pressure" for the elastomer packer relative to the size of the borehole.

If the total inflation pressure for the packer exceeds the fracture pressure of a hard rock formation or a friable formation, small fractures may be initiated along the packer and formation interface. In the worst case, these fractures or cracks can form a fluid communication path along the length of the packer element ("seal" length). In order to prevent this from occurring, the installation must be planned to insure that the total inflation pressure does not exceed the fracture pressure of the surrounding rock formation.

If the total inflation pressure for a packer exceeds, the packer breakdown pressure of a soft rock formation, the formation may experience breakdown and cannot hold inflation pressure above this value. When this occurs surface volumetric data may erroneously indicate an enlarged well hole. This is a common occurrence in Gulf Coast wells where the annular pressure during the primary cement job may be near the formation breakdown pressure but does not result in failure of the installation as the soft rock formations do not crack.

For installations where packers are run inside a liner or casing pipe, the internal yield pressure of the pipe must not be exceeded by the inflation pressure of the packer.

Figure 4:
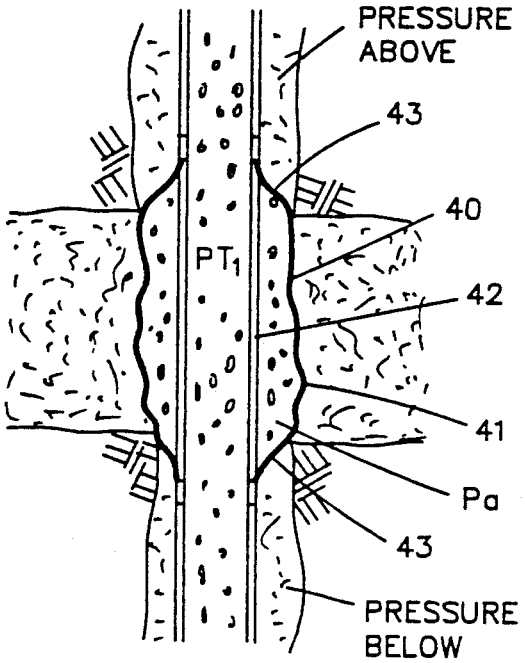
FIG. 4 illustrates the various fluid pressures acting on the inflated packer of FIG. 3.

In an open hole installation, the pressures that act on a liquid filled Inflatable Formation Packer 40 are illustrated in FIG. 4. The inflation pressure $P_I$ in the elastomer packer element 41 is the same as the inflation pressure $PT_I$ in packer mandrel 42. The mid-section of the packer element 41 is an unsupported elastomer element which is adapted to conform to wellbore irregularities (including washouts) in wellbores up to 5 times the O.D. of the uninflated packer element and which compresses under the effect of pressure. Since the mid-section of the packer element is not constrained, the inflation pressure $P_I$ acts directly on the wall of the wellbore although pore pressure of fluids within the formation offsets a portion of the packer pressure on the wall. The net pressure acting on the wall of the formation (inflation pressure - pore pressure) is defined as a "seal" load. Since the seal load is the net force acting radially against the contact area of the wellbore, the seal load acts to restore the stress that is lost in the formation when the hole is drilled and is equal to the effective radial stress.

From the foregoing it can be appreciated that the maximum differential pressure that can be safely applied to the center of the element is a function of fracture pressure which is independent of hole size up to 5 times the O.D. of the uninflated packer element ("run-in" diameter).

Each end section of the inflatable element 40 can have pliant petal-shaped metal support reinforcements 43 which are embedded in the end section of the elastomer element 41 and are enclosed in the adjacent sub 31 or 32. The metal reinforcements 43 are of sufficient length to extend between the packer mandrel 42 and the wall of the wellbore when the packer is inflated. The pressure that acts on the end sections 43 is the differential pressure between the inside of the elastomer element (pressure $P_I$) and the annulus pressure (pressure $P_{A1}$ downhole of the packer 40 and pressure $P_{A2}$ uphole of packer 40). This differential pressure is called the differential inflation pressure. The strength of the end sections is a function of the annular area in a radial cross-section of the annulus and the wellbore geometry. Generally, the smaller the annular area, the stronger the end section.

If the pressure in the annulus either above or below the inflatable element 41 is increased to a pressure that is greater than the initial inflation pressure, the deformable end sections are designed to transfer this pressure to the inflation fluid within the packer. This self energizing feature maintains the annular seal in cases where treating or injection pressures in the wellbore exceed initial inflation pressure of the packer, and the packer was inflated with mud. However, this increased inflation pressure will then increase the differential inflation pressure on the opposed end assembly 43. If this exceeds the strength of the end assembly, the packer element will be damaged.

It is important to note that the elastomer element of a cement inflated Formation Packer also self energizes in a manner likened to an elongated packing element in a compression type packer. In this case the sealing capability is limited only by the strength or elasticity of the formation independent of hole size.

As discussed above, the maximum differential pressure that a liquid filled inflatable packer can safely hold is primarily a function of hole size (annular area). However, other factors such as borehole geometry, hole deviation, centralization, and temperature changes during well treatments can also induce non-uniform and excessive stresses on an end assembly of the packer element.

Figure 5:
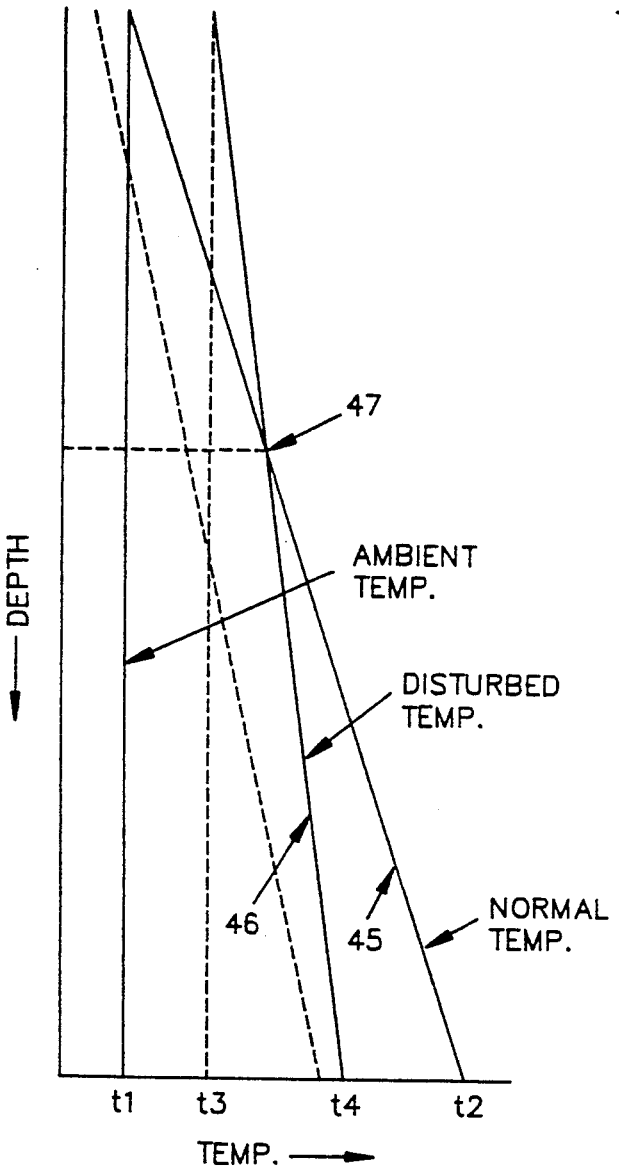
FIG. 5 is a graphical plot of borehole temperature versus depth.

Referring now to FIG. 5, where the wellbore traverses earth formations from the earth's surface (ground zero "0" depth) to a total depth (TD), the earth formations, the liners and the cement in the borehole in a quiescent undisturbed state will have a more or less uniform temperature gradient 45 from an ambient temperature value $t_1$, at "0" depth (ground surface) to an elevated or higher temperature value $t_2$ at a total depth TD. A quiescent undisturbed state is herein defined as that state where the wellbore temperature gradient is at a normal in-situ temperature undisturbed by any operations in the wellbore.

Liquids which are circulated in the wellbore during drilling, cementing and other operations can and do cause a temperature disturbance or temperature change along the wellbore where the in-situ undisturbed temperature values are changed by the circulation of the liquids which cause a heat transfer to or from the earth formations. A circulating liquid in the well changes the temperature values along the length of the wellbore as a function of depth, time and circulation rate so that a more or less uniform disturbed temperature gradient 46 is produced which has a higher temperature value $t_3$ than the temperature value $t_1$ at "0" depth and a lower temperature value $t_4$ than the in-situ undisturbed temperature value $t_2$ at the depth TD. The plot of the disturbed temperature gradient 46 will intersect the plot of the undisturbed temperature gradient 45 at some depth point 47 in the wellbore. Below the crossover temperature depth point 47, the wellbore will generally be at a lower temperature than it would normally be in its quiescent undisturbed state. Above the cross-over temperature depth point 47, the wellbore will generally be at a higher temperature than it would normally be in its quiescent undisturbed state. It will be appreciated that a number of factors are involved in the temperature change and that, in some operations, the downhole TD temperature can approach ambient surface temperature because of the heat transfer mechanism of the circulating fluids and fluids used in the operation.

Figure 6:
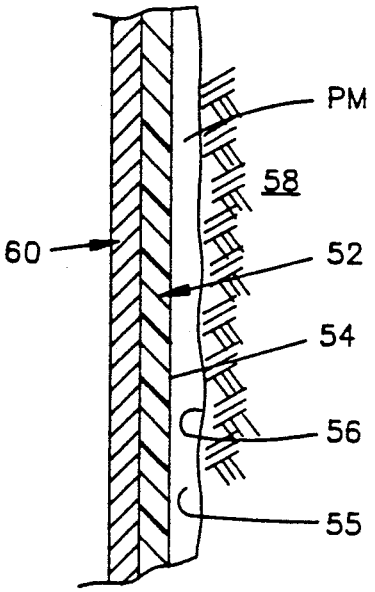
FIG. 6 is a fragmentary view in longitudinal cross section of an inflatable packer in a wellbore.
Figure 7:
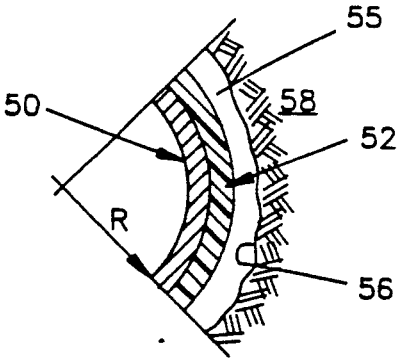
FIG. 7 is a fragmentary view in transverse cross section of an inflatable packer in a wellbore.
Figure 8:
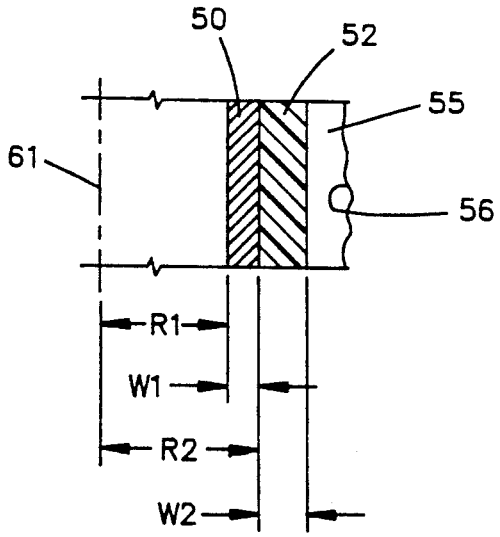
FIG. 8 is a view similar to FIG. 6 but showing radial dimensions and thicknesses of some of the packer components.

In FIG. 6, a fragmentary view of an inflatable packer in an uninflated condition is shown in longitudinal cross section and in FIG. 7, a partial transverse cross-section of the packer in a wellbore is illustrated. In the illustrations of FIGS. 6 and 7, the central mandrel 50 of the inflatable packer supports an elastomer inflatable packer element 52 of the type herein described. The outer wall surface 54 of the packer element 52 is spaced by an annular gap 55 from the interior wall 56 of a borehole traverses earth formations 58. As shown schematically in FIG. 8, the central mandrel 50 of the packer has an inner radius $R_1$ and a wall thickness, $W_1$. The packer element 52 has an inner radius $R_2$ and a wall thickness $W_2$.

Figure 9:
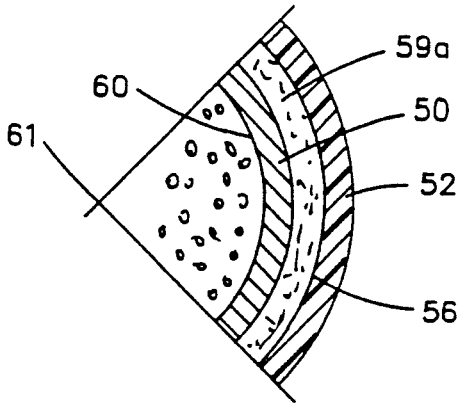
FIG. 9 is a view similar to FIG. 7 but showing the packer in inflated sealing condition in the wellbore.

In FIG. 9, a partial transverse cross-section of the inflatable packer illustrates the inflation of the packer element 52 into contact with the borehole wall 56 with a cement slurry **59*a* disposed between the packer seal element 52 and the borehole wall 56 on an initial inflated condition at a time prior to curing the cement slurry 59*a*. At this time, the cement slurry 59*b* is also in the bore 60 of the central mandrel 50 and is at a same pressure $P_1$ as the inflation pressure $P_2$ of the cement slurry 59*a* in the inflatable packer seal element 52**.

With respect to temperature effects, the temperature change in the central mandrel 50 and elastomer seal element 52 is minimal when the packer is first disposed in the wellbore to its desired location because the equipment has a relatively large mass and is introduced both at the surface ambient conditions. The cement slurry is also introduced at surface ambient conditions. If desired, the cement slurry can further be reduced in temperature at the surface or mixed with ice to reduce its temperature.

Prior to inflating the packer seal element 52 there is a hydrostatic or mud pressure $P_m$ in the borehole. Since the pressure $P_T$ in the mandrel 50 is equal to the pressure $P_m$, there is no differential pressure to affect the wall thickness $w_1$ of the mandrel 50. However, when the cement slurry **59*a* is introduced under the pressure Pc, the slurry 59*a* compresses the packer seal element 52 and reduces its wall thickness to a thickness less than the wall dimension $w_2$ and the compressive force in the elastomer element 52 seals the element 52 against the borehole wall 56 (See FIG. 9**).

At the selected final inflation pressure of the packer, the inflating medium at a pressure $P_c$ is trapped within the packer element 52 by a conventional valve system (not shown) in the inflatable packer. Thereafter, the pressure $P_c$ in the central member 50 is released to reduce to an ambient pressure value. At this time there is a pressure differential across the wall of the central mandrel 50 which radially compresses the central member 50 inwardly towards its central axis 61.

Figure 10:
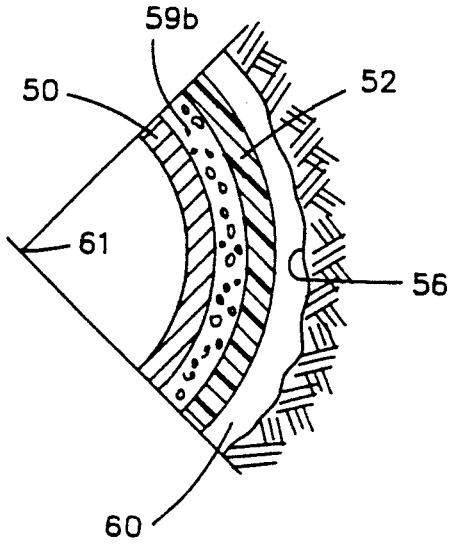
FIG. 10 is a view similar to FIG. 9 but showing shrinkage and dimensional changes of components of the inflated packer which are induced by temperature changes.

As described before, the inflation pressure of the packer develops strain energy in the mandrel 50, the cement slurry 59*a*, the packer seal element 52 and the surrounding rock formation. Thereafter, the cement slurry 59*a* cures to a solid form and generally changes bulk volume (changing the layer thickness) as shown in exaggerated form by 59*b* in FIG. 10. This results in a change of strain energy in the packing system.

In time, however, the strain energy in the system will again change because the temperature in the central mandrel 50, the hardened cement slurry 59*c* and the packer element 52 will increase (or decrease) to the in-situ undisturbed temperature at the depth of the packer element in the wellbore. The change in temperature in all of these elements causes a change in the radial dimensions (thickness) principally in the elastomer packer seal and mandrel elements which increases (or decreases) the strain energy in the system. The effect of temperature change is greatest on the elastomer packer element. The strain energy increases when the packer is located below the cross over temperature depth point illustrated in FIG. 5 and decreases when the packer is located above the cross over temperature depth point.

In either case, if the packer seal element 52 lacks the desired final strain energy (is not sufficiently compressed) after all of the elements at the packer location return to an undisturbed temperature, the shrinkage and dimensional changes of the cement and the elastomer packer element can produce an annular gap 60 (exaggerated for illustration) between the elastomer seal element 52 and the borehole wall 56 or lack sufficient pressure to maintain a seal.

In the present invention a precise inflation pressure to obtain a desired contact stress force can be determined so that the gap 60 or a loss of seal with the borehole wall pressure to permit a leak does not occur and a sufficient desired contact pressure remains in the packer seal element to maintain a seal without borehole fluid leakage even after the packer elements in the borehole return to their undisturbed temperature values.

Figure 11:
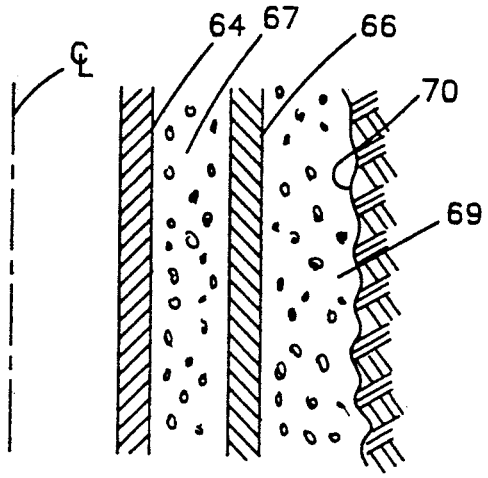
FIG. 11 is a view in partial longitudinal cross-section showing radial components of a multilayered liner system.
Figure 12:
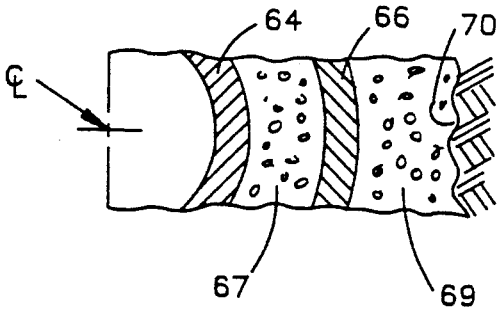
FIG. 12 is a view on partial horizontal cross-section of FIG. 11.

While the above description relates to a single liner, it can be appreciated that in a wellbore, a given cross-section of wellbore at a given depth can have an infinite variety of configurations. As shown in FIGS. 11 and 12, a given cross-section of a wellbore can include, an inner tubular member or liner 64 located within an outer tubular member or liner 66 with a cemented annulus 67 between the liners 64,66 and a cemented annulus 69 between the outer liner 66 and the borehole wall 70. Thus, within the wellbore, there an be a composite number of different packer elements or packer materials at the given cross-section as just described.

In practicing the present invention, the first step is to obtain the quiescent or in-situ undisturbed temperature in the wellbore as a function of depth. This can be done with a conventional temperature sensor or probe which can sense temperature along the wellbore as a function of depth. This temperature data as a function of depth can be plotted or recorded. Alternatively, a program such as "WT-DRILL" (available from Enertech Engineering & Research Co., Houston, Tex.) can be used at the time the well completion is in progress.

In the WT-DRILL program, well data is input for a number of parameters for various well operations and procedures. Data input includes the total depth of the wellbore, the various bore sizes of the surface bore, the intermediate bores, and the production bores. The outside diameters (OD), inside diameters (ID), weight (WT) of suspended liners in pounds/foot and the depth at the base of each liner is input data. If the other well characteristic are involved, the data can include, for deviated wells, the kick off depth or depths and total well depth. For offshore wells, the data can include the mudline depth, the air gap, the OD of the riser pipe, and the temperature of the seawater above the mudline, riser insulation thickness and K values (btu/hr-Ft-F). Input of well geometry data can include ambient surface temperature and static total depth temperature. In addition, undisturbed temperature at given depths can be obtained from prior well logs and used as a data input. The Mud Pit Geometry in terms of the number of tanks, volume data and mud stirrer power can also be utilized. The mud pit data can be used to calculate mud inlet temperature and heat added by mud stirrers can be related to the horsepower size of the stirrers.

Drilling information of the number of days to drill the last section, the total rotating hours, start depth, ending depth and mud circulation rate are input data. The drill string data of the bit size, bit type, nozzle sizes or flow area, the OD, ID and length of drill pipe (DP), the DP and collars are input data. The mud properties of density, plastic viscosity and yield point are input data.

Post Drilling Operations includes data of logging time, circulation time before logging, trip time for running into the hole, circulation rate, circulation time, circulation depth, trip time to pull out of the hole.

Cementing data includes pipe run time, circulation time, circulation rate, slurry pump rate, slurry inlet temperature, displacement pump rate and wait on cement time. Also included are cement properties such as density, viscometer readings, test temperature and bulk contraction (shrinkage). Further included are lead spacer specification of volume, circulation rate, inlet temperature, density, plastic viscosity and yield point.

Thermal properties of cement and soil such as density, heat capacity and conductority are input. The time of travel of a drill pipe or a logging tool are data inputs.

All of the forgoing parameters for obtaining a temperature profile are described in "A Guide For Using WT-Drill", (1990) Enertech Computing Corp., Houston, Tex.

In the present invention, the disturbed temperature as a function of depth can be determined from the WT-Drill Program just prior to running an inflatable packer.

As discussed above, the packer element when run in the wellbore will be inflated with a cement slurry, which is then pressured to establish a contact stress between the packer element and the wall of the wellbore. A successful sealing application of this packer in a wellbore depends upon the contact stress remaining after cement shrinkage and after temperature changes occur when the wellbore returns to a quiescent undisturbed state.

In order to predict with some certainty the final wellbore contact stress, a thermal profile of the wellbore prior to inflating the packer is utilized with the inflation pressure for the packer in a horizontal plane strain determination to obtain a value for the contact stress after the wellbore returns to an undisturbed state or condition. In some instances it will be determined that the packer cannot obtain the desired results thus predetermining that a failure will occur. When the contact stress as thus determined is insufficient or inadequate for effecting a seal, then the inflation pressures or the packer parameters can be adjusted to utilize sufficient inflation pressure or to design the right packer for the operation. In all instances the stresses are established for future reference values.

The residual contact stress is determined by a stress analysis of the mandrel, the cement, the elastomer and the formation. The stress analysis is based on the radial strains in the layered components of the packing system as taken in a horizontal plane where the radial strains are fairly symmetric about the central axis of the mandrel. In elastic strain analysis a plane strain axi-symmetric solution of static equilibrium equations with respect to temperature changes for a given layered component in a system is stated as follows:

$$u(R_o) = \frac{(1+\nu)}{(1-\nu)} a \frac{1}{r} \int_{R_i}^{R_o} \Delta T(\xi)\xi d\xi + C_1 r_o + C_2/r^2 \quad (1)$$

$$\sigma_r(R_o) = -\frac{aE}{(1-\nu)} \frac{1}{r^2} \int_{R_i}^{R} \Delta T(\xi)\xi d\xi + \frac{\lambda}{\nu} C_1 - 2GC_2/r^2 \quad (2)$$

$$\sigma_\theta(R) = -\frac{aE}{(1-\nu)} \frac{1}{r^2} \int_{R_i}^{R} \Delta T(\xi)\xi d\xi \frac{aE\Delta T(r)}{(1-\nu)} + \frac{\lambda}{\nu} C_1 - 2GC_2/r^2 \quad (3)$$

$$\sigma_z(R) = \frac{aE\Delta T(r)}{(1-\nu)} + 2\lambda C_1 \quad (4)$$

where:

r—radius (in)

$r_i$—inside radius (in)

u(r)—radial displacement (in)

$\sigma_x(r)$—radial stress (psi)

$\sigma_\theta(r)$—hoop stress (psi)

$\sigma_z(r)$—axial stress (psi)

E—Young's modulus (psi)

$\nu$—Poisson's ratio

G—Shear modulus, 2G—E/(1+$\nu$), (psi)

$\lambda$—Lame's constant, $\lambda=2G\nu/(1-2\nu)$, (psi)

a—coefficient of linear thermal expansion (1/F)

$\Delta T$—temperature change (F) and is a function of r with respect to RdR $C_1$, $C_2$—constants determined by boundary conditions $\xi$—is a symbol for R for notational purposes R—any radius between $r_o$ and $r_i$ In one aspect of the invention, the hoop stress (Equation 3) and axial stress (Equation 4) are not considered significant factors in determining the sealing effects of an inflatable packer after the wellbore returns to its in-situ undisturbed conditions.

Figure 13:
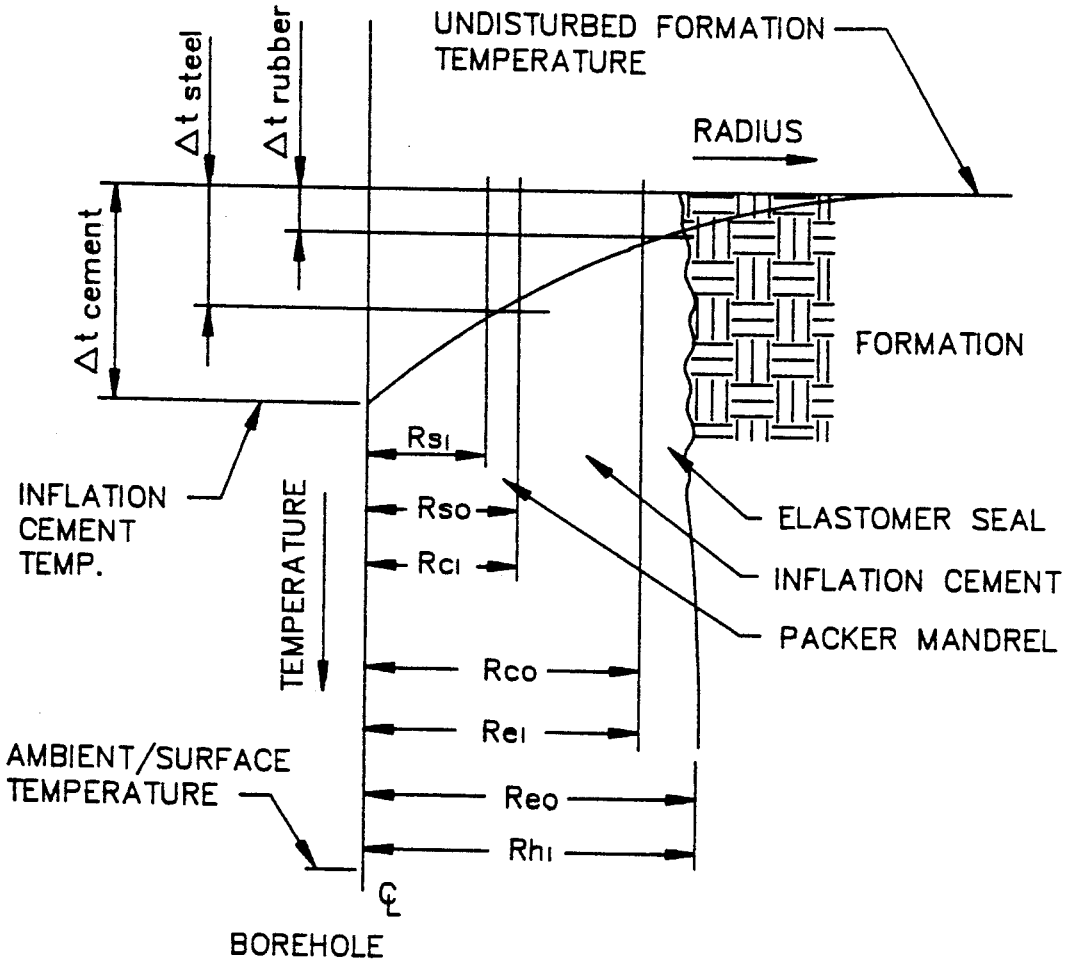
FIG. 13 is a schematic plot of temperature distribution as a function of radii of layer of a packer system.

Considering Equations (1) and (2) then for radial displacement and radial stress it can be seen that each layer at a given horizontal plane in a wellbore has two unknown coefficients $C_1$ and $C_2$. By way of reference and explanation, FIG. 13 is a partial schematic diagram of a wellbore illustrating a center line CL and radially outwardly located layers of steel, cement, elastomer and earth formations. Overlaid on the FIG. 13 illustration is a temperature graph illustrating increasing temperatures along the vertical CL axis from a formation temperature $T_f$ to a wellbore temperature $T_H$. At a medial radial location in the steel liner, there is a temperature $T_S$ which is lower than the temperature $T_H$. A median radial location in the cement has a temperature $T_C$ which is lower than the temperature $T_S$. A median radial location in the elastomer has a temperature $T_R$ which is lower than the temperature $T_C$. At some radial distance into the formation beyond the elastomer seal, an undisturbed formation temperature $T_F$ exists. With a disturbed condition in the wellbore the temperature of the components defines a gradient from a location at the center of the wellbore to a location in the formation temperature $T_F$.

As the illustration in FIG. 13 shows, the various layers are defined between their radii as follows:

steel layer between $R_{SI}$ and $R_{SO}$ cement layer between $R_{CI}$ and $R_{CO}$ elastomer layer between $R_{EI}$ and $R_{EO}$ and where the following inside radii and outside radii are equal.

$R_{SO}=R_{CI}$ $R_{CO}=R_{EI}$ $R_{EO}=R_{HI}$

In FIG. 13, only a single liner is illustrated for simplicity of illustration. At the depth location illustrated in FIG. 13, a temperature gradient occurs between a radius location in the formation where the temperature $T_F$ is at the undisturbed formation temperature and a center line location in the wellbore where the temperature $T_H$ is at the wellbore temperature. The shape of the gradient is largely a function of the properties of the formations and can be almost linear.

All of the parameters of Equations (1) and (2) are predetermined for each layer of the system so that the only unknowns for each layer are the coefficients $C_1$ and $C_2$. By definition, the coefficients $C_1$ and $C_2$ for the interface between the steel and cement are equal, the coefficients $C_1$ and $C_2$ for the interface between the cement and the elastomer are equal and the coefficients $C_1$ and $C_2$ for the interface between the elastomer and the borehole wall are equal. In other words, the stress at one edge of one layer wall is equal to the stress at the edge of an adjacent layer wall.

In the fundamental analysis then, there are two equations (1) and (2) for the steel layer and two equations (1) and (2) for the cement layer which total four equations and two unknown coefficients.

The equations can be solved by Gauss elimination or block tridiagonals. In the solution, a desired inflation pressure is selected and the associated contact sealing pressure is determined.

Material Properties

The solution of the above stress formula requires a determination the elastic properties of several diverse materials in the layers. Steel properties do not vary greatly and are relatively easy to obtain:

| Common reported values are: | Values selected for use |
|---|---|
| Young's modulus: E = 28-32 × $10^6$ psi | 30 × $10^6$ |
| Poisson's ratio: v = 0.26-0.29 | .29 |
| Thermal expansion: a = 5.5-7.1 × $10^{-6}$/F | 6.9 × $10^{-6}$ |

Rock or formation properties are considerably more varied and some properties are more difficult to find, such as the thermal expansion coefficients for different materials:

Values associated with representative formation materials include the following:

| Limestone: |
|---|
| Young's modulus: E = 73-87 × $10^5$ psi |
| Poisson's ratio: v = 0.23-0.26 |
| Thermal expansion: a = 3.1-10.0 × $10^{-5}$/F |

-continued

| | |
|---|---|
| Sandstone: | |
| Young's modulus: E = 15-30 × $10^5$ psi | |
| Poisson's ratio: v = 0.16-0.19 | |
| Thermal expansion: a = 3.1-7.4 × $10^{-6}$/F | |
| Shale: | Values selected for use: |
| Young's modulus: E = 14-36 × $10^5$ psi | 30 × 105 |
| Poisson's ratio: v = 0.15-0.20 | .18 |
| Thermal expansion: a = 3.1-10.0 × $10^{-6}$/F | 3.1 × $10^{-6}$ |

Cement properties vary with composition. The following values for cement are considered nominal:

| | Values selected for use |
|---|---|
| Young's modulus: E = 10-20 × $10^5$ psi | 15 × $10^5$ |
| Poisson's ratio: v = 0.15-0.20 | .20 |
| Thermal expansion: a = 6.0-11.0 × $10^{-6}$/F | 6.0 × $10^{-6}$ |

The volume change of the cement layer due to cement hydration and curing is needed for the analysis, and is one of the critical factors in determining the residual contact stress between the packer and the formation. A study by Chenevert [entitled "Shrinkage Properties of Cement" SPE 16654, SPE 62nd Annual Technical Conference and Exhibition, Dallas, Tex. (1987)] indicates a wide variation in cement shrinkage because of different water and inert solids content. It appears that a shrinkage of about 2% is the minimum that can be achieved. Cement producing this minimum shrinkage can be used in the practice of this invention for optimum results. In any event, with the packer and cement parameters, the thickness of the cement annulus after curing can be predetermined.

Elastomer properties are critical in stress analysis because the elastomer is the most compliant material and it is least sensitive to cement shrinkage. High compliance, or low elastic modulus means small stress changes for small strains. However, because rubber has the largest coefficient of thermal expansion, it is most sensitive to temperature changes. The following values for nitrile rubber were estimated from various research sources.

| | Value selected for use |
|---|---|
| Young's modulus: E = 400-800 psi | 640 |
| Poisson's ratio: v = 0.49932-0.499356 | .49934 |
| Thermal expansion: a = 6.0-13.0 × $10^{-5}$/F | 13. × $10^{-5}$ |

The Poisson's ratio of 0.49934 and the Young's modulus of 640 psi implies a bulk modulus for the nitrile rubber of about 162,000 psi. The range for bulk modulus for nitrile rubber is 150,000 to 350,000 psi.

EXAMPLES OF ESTIMATED CONTACT STRESSES GENERATED BY AN INFLATABLE PACKER

The formation contact stresses for certain wells were determined using the following assumptions:

| |
|---|
| Rubber Elastic Modulus = 400 psi |
| Rubber Poisson Ratio = .49934 |
| Cement Shrinkage = 2% |

The following example for practicing the invention is in a well based on a frac pressure of 4400 psi, a packer depth of 8600 ft., and bottom hole pressures of 3000 psi. The inflation pressure of the inflatable packer was rated to safely exceed hydrostatic pressure by 1400 psi.

At this point then, a selection of inflation pressure was made. The value of 1350 psi (slightly less than 1400 psi) was used as a selected inflation pressure increment. At the depth where inflation of the packer is intended, the temperature differential is +10° F. (below the temperature cross-over depth point).

The 7" packer has a 8.035" O.D. and Well #1 is 8½" wellbore. The following are the layer characteristics for the mandrel, the cement, the elastomer, and the earth formation (rock) in an inflated condition:

| | | | WELL #1 8½" I.D. | | |
|---|---|---|---|---|---|
| LAYER | INSIDE RADIUS (IN) | OUTSIDE RADIUS (IN) | YOUNGS MODULUS (PSI) | POISSONS RATIO | COEF LIN THERM EXPNSN (1/F) |
| Mandrel | 3.09 | 3.50 | 30.00E+6 | .290 | 6.900E−6 |
| Cement | 3.50 | 3.72 | 15.00E+5 | .200 | 6.000E−6 |
| Elastomer | 3.72 | 4.25 | 400. | .49934 | 1.300E−4 |
| Rock | 4.25 | * | 30.00E+5 | .180 | 3.000E−7 |

*equals the radius at which the formation temperature remains undisturbed.

The temperature differential T for the various layers at the desired depth is obtained from a WT Drill program. Utilizing Equations (1) and (2) above with the ΔT determinations and an inflation pressure of 1350 psi above hydrostatic pressure, gave the following stress results for the various layers while the cement is still liquid:

| | (a) INCREMENTAL | | | | TOTAL | |
|---|---|---|---|---|---|---|
| LAYER | INSIDE RADIUS (IN) | OUTSIDE RADIUS (IN) | INSIDE STRESS (PSI) | OUTSIDE STRESS (PSI) | INSIDE STRESS (PSI) | OUTSIDE STRESS (PSI) |
| Mandrel | 3.09 | 3.50 | 1350. | 1350. | 4350. | 4350. |
| Cement | 3.50 | 3.72 | 1350. | 1350. | 4350. | 4350. |
| Elastomer | 3.72 | 4.25 | 1350. | 1349. | 4350. | 4349. |

-continued (a)

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Rock | 4.25 | * | 1349. | * | 4349. | * |

Next utilizing Equations (1) and (2) above with the ΔT determinations and assuming the condition when inflation pressure is trapped in the packer and the pressure in the string of tubing is adjusted to hydrostatic pressure, and using a cement volume change upon curing equal to −0.0200 ft3/ft3, the stress in the layers calculated at the time the packer cement has hardened is:

(b)

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Mandrel | 3.09 | 3.50 | 0. | 1708. | 3000. | 4708. |
| Cement | 3.50 | 3.72 | 1708. | 1020. | 4708. | 4020. |
| Elastomer | 3.72 | 4.25 | 1020. | 1020. | 4020. | 4020. |
| Rock | 4.25 | * | 1020. | * | 4020. | * |

It can be seen that the contact stress of the elastomer is at 1020 psi. If the desired contact sealing force is 1000 psi or more, then this is sufficient sealing contact pressure and the packer can be run in the wellbore and inflated to 1350 psi above the hydrostatic pressure of 3000 psi with a resultant ultimate contact stress of 1020 psi.

To determine the contact force after the wellbore returns to an undisturbed temperature condition, the Equations (1) and (2) are solved for the in-situ temperature. In the example, the temperature increase is 10° F. The results are:

(c)

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Mandrel | 3.09 | 3.50 | 0. | 1937. | 3000. | 4937. |
| Cement | 3.50 | 3.72 | 1937. | 1243. | 4937. | 4243. |
| Elastomer | 3.72 | 4.25 | 1243. | 1243. | 4243. | 4243. |
| Rock | 4.25 | * | 1243. | * | 4243. | * |

The temperature increase of 10° F. at the location of the packer illustrates that higher contact stresses are obtained in the elastomer layer at the higher undisturbed temperature.

If the location of the packer was above the cross-over depth point and the undisturbed temperature was 10° F. lower than the disturbed temperature then the results would decrease the stress in the elastomer below 1020 psi (see "b" above) because of the temperature contraction of the elastomer.

The above results show in that a 1000 psi contact stress can be achieved for the 7" packer in the 8½" hole. A temperature increase of 10° F. in the undisturbed in-situ temperature adds about 200 psi to the results which illustrates the effect of temperature on contact stress.

As discussed heretofore, there are two unknown boundary constants $C_1$ and $C_2$ for each layer of material. The stress analysis of the packer to formation assemblage (radial layers of materials) is determined by matching boundary conditions at the inside of the mandrel, at the interfaces between layer components and at the outside radius of the wellbore.

There are two load cases considered in the above packer analysis, (1) the packer inflation pressure with a cement slurry and (2) the packer contact stress with the wellbore after the cement sets. In the packer inflation case, the conditions used are:

1. the radial pressure at the inside radius of the mandrel is at the inflation pressure;
2. the radial pressure at the outside radius of the mandrel is the inflation pressure;
3. the cement is considered a fluid at the inflation pressure, so the stress formulas are not used;
4. the radial pressure at the inside radius of the elastomer element is at the inflation pressure;
5. for open hole applications, the displacement and radial stress at the outside radius of the elastomer element match the displacement and radial stress at the inside radius of the wellbores; the displacement of the formation at infinity is zero;
6. for packer inflation pressure inside casing or liners, the displacement and radial stress at the outside of the elastomer element match the displacement and radial stress of the casing; outside the casing may be more cemented casings, a fluid filled annulus, or formation. Between all solids, cement, steel, or formation, the displacement and radial stress must be continuous. For a fluid filled annulus, the fluid pressure must be applied to the outside radius of the last casing.

Analysis of the case of the packer after the cement sets differs only in the treatment of the cement. In this case the cement is considered a solid, so that the following boundary conditions are used:

1. The displacement and radial stress at the outside radius of the mandrel match the displacement and radial stress at the inside radius of the cement.

2. The displacement and radial stress at the outside radius of the cement match the displacement and radial stress at the inside radius of the rubber.

The set of boundary conditions forms a block tridiagonal set of equations with unknown constants $C_1$ and $C_2$ for each layer of material. The boundary conditions are solved using a conventional block tridiagonal algorithm.

After the cement sets, the temperature change is utilized to determine the contact stress when the wellbore returns to an undisturbed temperature condition.

In the above example, it is established that the selected inflation pressure is a function of the ultimate contact stress. Thus, the analysis process can be used so that for a selected inflation pressure, the ultimate contact stress can be determined before the packer is used in a wellbore. Therefore, it is predetermined that the packer will obtain a sufficient contact stress after the well returns to an undisturbed condition.

Alternatively, a desired contact stress can be selected and the inflation pressure necessary to achieve the selected contact stress can be determined. This permits the operator to safely limit contact pressures by controlling the inflation pressure. This also predetermines if the inflation pressure is within the capabilities of the packer.

Stated another way, the maximum inflation pressure obtains a maximum contact stress. However, because of wellbore conditions, the maximum inflation pressure for the packer in a given borehole may be insufficient to obtain a satisfactory contact stress so that the inflatable packer would be unproductive and expensive. Similarly, for a desired contact stress it can be determined that the packer would be ruptured or otherwise exceed its rated limits. Similarly, in casing or liners which have weaknesses, a precise inflation pressure to obtain a precise contact stress can be determined and utilized.

In the foregoing explanation of the present invention, only equations (1) and (2) were employed as a fundamental example where the z axis and hoop stress are effectly valued at zero.

This is a solution based upon isotropic cement contraction in which the change in wall thickness is greater than actually encountered which provides a safety factor.

The effect of plane strain cement contraction can best be understood by consideration of the following examples:

CASE 1

This packer is a 7" nominal (8⅛" O.D.) packer

LAYER PROPERTY SUMMARY

| LAYER | INSIDE DIAMETER (IN) | OUTSIDE DIAMETER (IN) | YOUNGS MODULUS (PSI) | POISSONS RATIO | COEF LIN THERM EXPNSN (1/45 F) |
|---|---|---|---|---|---|
| Mandrel | 6.28 | 7.00 | 30.00E+6 | 0.29000 | 6.900E−6 |
| Cement | 7.00 | 9.11 | 15.00E+5 | 0.20000 | 6.000E−6 |
| Elastomer | 9.11 | 10.00 | 640. | 0.49934 | 1.300E-4 |
| Rock | 10.00 | * | 30.00E+5 | 0.18000 | 3.000E−7 |

The following differential temperature profile was used

| RADIUS (IN) | TEMPERATURE (F) |
|---|---|
| 3.40 | 5.00 |
| 4.50 | 5.00 |
| 10.00 | 5.00 |
| 100.00 | 0.00 |

Utilizing Equations (1) and (2) above with the ΔT determinations and a packer inflation pressure of 1000 psi above pore pressure of 2000 psi, gives the following stress results for the various layers while the cement is still liquid:

(a)

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Mandrel | 3.14 | 3.50 | 1000. | 1000. | 3000. | 3000. |
| Cement | 3.50 | 4.55 | 1000. | 1000. | 3000. | 3000. |
| Elastomer | 4.55 | 5.00 | 1000. | 966. | 3000. | 2966. |
| Rock | 5.00 | * | 966. | * | 2966. | * |

Next utilizing Equations (1) and (2) above with the ΔT determinations and assuming the condition when inflation pressure is trapped in the packer and in the string of tubing is adjusted to hydrostatic pressure, and using a cement volume change upon curing equal to −0.0200 ft3/ft3, the stress in the layers calculated at the time the packer cement has hardened and the wellbore has returned to its original undisturbed temperature (+5° F.) is:

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Mandrel | 3.14 | 3.50 | 0. | 1538. | 2000. | 3538. |
| Cement | 3.50 | 4.55 | 1538. | −973. | 3538. | 1027. |
| Elastomer | 4.55 | 5.00 | −973. | 1007. | 1027. | 993. |
| Rock | 5.00 | * | −1007. | * | 993. | * |

It can be seen that the contact stress of the elastomer is at −1007 psi which means there is a seal load failure because the cement volume contraction (wall thickness) decreased more than the expansion effect on the elastomer due to the temperature change. With the above Case 1, the wall thickness of the uninflated elastomer element was 0.5625 inches.

CASE 2

The effect of increasing the wall thickness of the above discussed elastomer element of case 1 is illustrated by the following case which has the same parameters except that the uninflated packer wall thickness is increased to 0.875 inches:

The stress example for case 1(a) is the same.

However, the stress in the layers calculated at the time the packer cement has hardened with a +5° F. temperature change is:

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Mandrel | 3.14 | 3.50 | 0. | 1868. | 2000. | 3868. |
| Cement | 3.50 | 4.12 | 1868. | 431. | 3868. | 2431. |
| Elastomer | 4.12 | 5.00 | 431. | 400. | 2431. | 2400. |
| Rock | 5.00 | * | 400. | * | 2400. | * |

This illustrates that by proper selection of a wall thickness of the elastomer element a positive seal load can be obtained where a common sized packer element would fail.

CASE 3

The effect of a higher temperature differential can be shown in the following instance which is the same parameters as Case 1 but using a 10° F. temperature differential.

The stress in the layers calculated at the time the packer cement has hardened is:

| LAYER | INCREMENTAL INSIDE RADIUS (IN) | INCREMENTAL OUTSIDE RADIUS (IN) | INCREMENTAL INSIDE STRESS (PSI) | INCREMENTAL OUTSIDE STRESS (PSI) | TOTAL INSIDE STRESS (PSI) | TOTAL OUTSIDE STRESS (PSI) |
|---|---|---|---|---|---|---|
| Mandrel | 3.14 | 3.50 | 0. | 2079. | 2000. | 4079. |
| Cement | 3.50 | 4.12 | 2079. | 636. | 4079. | 2636. |
| Elastomer | 4.12 | 5.00 | 636. | 605. | 2636. | 2605. |
| Rock | 5.00 | * | 605. | * | 2605. | * |

It can be seen that an increase of 10° F. causes the final seal load to increase to 605 psi.

One of the ways to obtain an increase of 10° F. is to decrease the temperature of the elastomer element by reducing its temperature prior to installation. In effect then the temperature differential would be great enough to effect a positive seal when the temperature returned to normal for the well.

CASE 4

In the following case, various parameters utilize in the WT-Drill program and temperature changes are as follows:

| WELL DEPTH/TMD (ft): | 8107 (to packer location) | | | | | |
|---|---|---|---|---|---|---|
| | SURFACE | INTER-MEDIATE | PROTEC-TIVE | PROTEC. LINER | PRODUC-TION | PRODUC. LINER |
| HOLE SIZE (in): | 20.00 | 14.75 | 9.50 | | | 6.50 |
| CEMENT TOP (ft): | 0. | 600. | 600. | 0. | 0. | 7800. |
| SECTION 1 | | | | | | |
| OD (in): | 16.0000 | 11.7500 | 7.6250 | | | 5.000 |
| WEIGHT (lb/ft): | 84.00 | 54.00 | 33.70 | | | 18.00 |
| ID (in): | 15.0100 | 10.8800 | 6.7650 | | | 4.2760 |
| DEPTH AT BASE (ft): | 800. | 7265. | 7300. | | | 8107. |
| WELLBORE DEVIATION | | | | | | |
| KICKOFF DEPTH (ft): | | | | | 40000. | |
| WELL TVD (ft): | | | | | 6990. | |
| OFFSHORE DATA (Optional) | | | | | | |
| MUDLINE DEPTH (ft): | | | | | 600. | |
| AIR GAP (ft): | | | | | 80. | |

-continued

| | |
|---|---|
| TEMPERATURE OF SEA-WATER ABOVE MUDLINE (F): | 45.0 |
| UNDISTURBED EARTH TEMPERATURES | |
| SURFACE AMBIENT (F): | 80.0 |
| WELL TD STATIC (F): | 165.0 |
| MUD PIT GEOMETRY | |
| # TANKS | 4 |
| PIT WIDTH (ft): | 10.00 |
| PIT LENGTH (ft): | 20.00 |
| PIT HEIGHT (ft): | 8.00 |
| MUD STIRRER POWER (per tank) (hp): | 15.0 |

Figure 15:
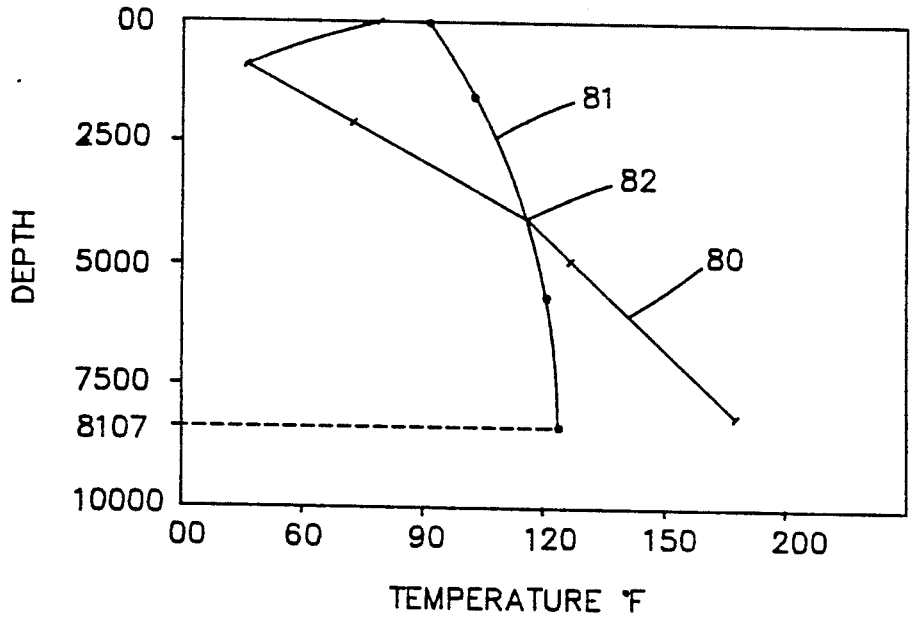
FIG. 15 is a temperature profile generated by a WT-Drill program.

Referring to FIG. 15, a plot of temperature vs. depth shows the undisturbed temperature gradient 80 and the disturbed temperature gradient 81. The cross over depth point 82 is at 5000 feet and at 8107 feet the temperature differential is about 38° F.

In Table I, it can be seen that at 8107 feet the "fluid" or cement temperature from the WT-Drill Program is 124° F. as compared to 160° F. for the undisturbed temperature. This is a 41° temperature differential between the inflation fluid and the undisturbed temperature at that depth.

WELL DATA

| CEMENTING EVENT DATA | | | LEAD SPACER | |
|---|---|---|---|---|
| PIPE RUN TIME (hr): | 8.00 | | VOLUME (bbl): | 5. |
| CIRCULATION TIME (hr): | 4.00 | | CIRCULATION RATE (gpm): | 200. |
| CIRCULATION RATE (gpm): | 200. | | INLET TEMP (F): | 80. |
| SLURRY PUMP RATE (bpm): | 4.00 | | DENSITY (ppg): | 16.40 |
| SLURRY INLET TEMP (F): | 80. | | PLASTIC VISCOSITY: | 80.0 |
| DISPLACE PUMP RATE (gpm): | 200. | | YIELD POINT: | 50.0 |
| WAIT-ON-CEMENT TIME (hr): | .00 | | | |
| SLURRY PROPERTIES | LEAD | TAIL (Optional) | | |
| DENSITY (ppg): | 16.40 | 16.40 | | |
| VISCOMETER READING | | | DISPLACEMENT FLUID | |
| R600: | 210. | 210. | INLET TEMP (F): | 80. |
| R300: | 130. | 130. | DENSITY (ppg): | 15.00 |
| R200: | | | PLASTIC VISCOSITY: | 40.0 |
| R100: | | | YIELD POINT: | 20.0 |
| R6: | | | | |
| R3: | | | | |
| TESTING TEMPERATURE (F): | 80.0 | 110.0 | | |
| VOLUME (bbl): | | 6. | | |

TABLE I

RESULTS AFTER SLURRY PLACEMENT

| | WELLBORE TEMPERATURES, F. | | | | | | |
|---|---|---|---|---|---|---|---|
| DEPTH | FLUID | STRING | ANNULUS | CASNG 1 | CASNG 2 | CASNG 3 | UNDIST. |
| 0. | 80. | 83. | 91. | 91. | 88. | 86. | 80. |
| 591. | 84. | 87. | 95. | 93. | 64. | 46. | 46. |
| 611. | 85. | 88. | 95. | 95. | 78. | 67. | 45. |
| 2000. | 95. | 97. | 103. | 103. | 91. | | 71. |
| 3200. | 103. | 105. | 110. | 110. | 103. | | 94. |
| 4000. | 108. | 110. | 114. | 114. | 112. | | 109. |
| 5200. | 114. | 116. | 120. | 120. | 122. | | 125. |
| 6000. | 118. | 119. | 122. | 122. | 128. | | 136. |
| 7200. | 122. | 123. | 125. | 125. | 136. | | 153. |
| 8000. | 124. | 125. | 125. | | | | 164. |
| 8107. | 124. | 125. | 125. | | | | 165. |

THE LAYER PROPERTY SUMMARY IS:

| LAYER | INSIDE DIAMETER (IN) | OUTSIDE DIAMETER (IN) | YOUNGS MODULUS (PSI) | POISSONS RATIO | COEF LIN THERM EXPNSN (1/F) |
|---|---|---|---|---|---|
| Mandrel | 4.28 | 5.00 | 30.00E+6 | 0.29000 | 6.900E−6 |
| Cement | 5.00 | 5.59 | 15.00E+5 | 0.20000 | 6.000E−6 |
| Elastomer | 5.59 | 6.50 | 640. | 0.49934 | 1.300E−4 |
| Rock | 6.50 | * | 20.00E+5 | 0.18000 | 3.000E−7 |

The temperature differential is:

| RADIUS (IN) | TEMPERATURE (F) |
|---|---|
| 2.32 | 38.10 |
| 2.69 | 38.90 |
| 3.81 | 31.80 |
| 5.01 | 24.51 |
| 6.21 | 19.36 |
| 7.41 | 15.69 |

TABLE I-continued

| RESULTS AFTER SLURRY PLACEMENT | |
|---|---|
| 8.60 | 13.06 |
| 9.80 | 11.11 |
| 11.00 | 9.65 |
| 13.00 | 8.39 |
| 27.97 | 1.49 |
| 60.20 | 0.04 |
| 129.56 | 0.00 |
| 278.81 | 0.00 |
| 600.00 | 0.00 |

The temperature differential ΔT for the Various layers at the desired depth obtained from a WT Drill program and utilizing equations (1) and (2) above with the ΔT determinations and a packer inflation pressure of 1000 psi above a pore pressure of 5380 psi, gives the following stress results for the various layers while the cement is still liquid:

| | INCREMENTAL | | | | TOTAL | |
|---|---|---|---|---|---|---|
| LAYER | INSIDE RADIUS (IN) | OUTSIDE RADIUS (IN) | INSIDE STRESS (PSI) | OUTSIDE STRESS (PSI) | INSIDE STRESS (PSI) | OUTSIDE STRESS (PSI) |
| Mandrel | 2.14 | 2.50 | 1000. | 1000. | 6380. | 6380. |
| Cement | 2.50 | 2.80 | 1000. | 1000. | 6380. | 6380. |
| Elastomer | 2.80 | 3.25 | 1000. | 984. | 6380. | 6364. |
| Rock | 3.25 | * | 984. | * | 6364. | * |

Next utilizing Equations (1) and (2) above with the ΔT determinations and assuming the condition when inflation pressure is trapped in the packer and in the string of tubing is adjusted to hydrostatic pressure, and using a cement volume change upon curing equal to −0.0200 ft3/ft3, the stress in the layers calculated at the time the packer cement has hardened is:

| | INCREMENTAL | | | | TOTAL | |
|---|---|---|---|---|---|---|
| LAYER | INSIDE RADIUS (IN) | OUTSIDE RADIUS (IN) | INSIDE STRESS (PSI) | OUTSIDE STRESS (PSI) | INSIDE STRESS (PSI) | OUTSIDE STRESS (PSI) |
| Mandrel | 2.14 | 2.50 | 0. | 2777. | 5380. | 8157. |
| Cement | 2.50 | 2.80 | 2777. | 1698. | 8157. | 7078. |
| Elastomer | 2.80 | 3.25 | 1698. | 1683. | 7078. | 7063. |
| Rock | 3.25 | * | 1683. | * | 7063. | * |

It can be seen that the seal load increases dramatically with increasing temperature of 38.1° F.

It will be appreciated that the forgoing process can be refined to determine the axial, radial and hoop cement shrinkage strains on an independent basis so that any combination can be used.

In cement, the relationship for stresses and strains for general cement shrinkage is given by:

$$E(\epsilon_r + \delta_r) = \sigma_r - \gamma(\sigma_z + \sigma_\theta)$$
$$E(\epsilon_\theta + \delta_\theta) = \sigma_\theta - \gamma(\sigma_r + \sigma_z)$$
$$E(\epsilon_z + \delta_z) = \sigma_z - \gamma(\sigma_r + \sigma_\theta)$$

Where:

$\epsilon_x$—strain in the radial direction
$\epsilon_\theta$—strain in the hoop direction
$\epsilon_z$—strain in the axial direction
$\delta_x$—cement volume decrease in the radial direction
$\delta_\theta$—cement volume decrease in the hoop direction
$\delta_z$—cement volume decrease in the hoop direction
$\sigma_r$—stress in the radial direction (psi)
$\sigma_\theta$—stress in the hoop direction (psi)
$\sigma_z$—stress in the axial direction (psi)
E—Young's modulus (psi)
$\gamma$—Poisson's ration where $\delta_x$ is the shrinkage in the r direction, $\delta_\theta$ is the shrinkage in the hoop direction, and $\delta_z$ is the shrinkage in the z direction. The total volume change is:

$$\Delta\gamma/\gamma = \delta_x - \delta_\theta - \delta_z$$

The radial strain only case is then a special case of this general model ($\delta_\theta = \delta_z = 0$).

The cement shrinkage option may be used to allow the cement to shrink only in the radial direction within the packer. The anticipated effect of this application is to decrease the radial compressive stress on the mandrel due to cement shrinkage. For example, if the cement is assumed to fail in the hoop direction, the hoop contraction should be set to zero.

The effect of cement shrinkage may be decreased due to axial movement of the cement during setting. In plane strain, the axial shrinkage affects the radial and hoop stresses through the Poisson effect. If axial movement is allowed (not plane strain), the axial shrinkage has no effect on the radial and hoop stresses. For this reason, the effect of the axial cement shrinkage is removed from the calculation.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. A method for determining the inflation pressure for an elongated inflatable packer to effect a positive seal of an elastomer packer element with a borehole wall in a wellbore traversing earth formations where the wellbore has a disturbed temperature condition relative to a quiescent temperature condition and where such packer has a central tubular mandrel and the elastomer packer element is mounted on said mandrel in sleeved relation thereto and where said packer element is subject to inflation by a finite inflation pressure of a liquid element from a source of liquid pressure to produce a radial expansion of said packer element and so that a final positive contact stress can be obtained between the packer element and the borehole wall and where the final positive contact stress enables the packer element to provide a seal with respect to the borehole wall, and where said mandrel, said packer element and said liquid element are radial layers of elements extending from a borehole centerline to the borehole wall, said method including the steps of:

selecting a depth in said wellbore for inflation of said packer element;

determining, for each layer at said depth, the temperature differential in a radial plane through said layers and surrounding earth formations between the temperature for each layer and the earth formations at a disturbed temperature condition in the wellbore and the quiescent temperature of each layer and the earth formation in undisturbed temperature conditions;

utilizing a desired final positive contact stress and the temperature differentials in an elastic strain analysis in respect to the layers of such tubular mandrel, said liquid packer element and the earth formations in a radial plane for determining the finite inflation pressure required to obtain said desired final positive contact stress; and running the packer into the wellbore and inflating the packer element with said liquid element at said selected depth with the finite inflation pressure required to obtain the desired final positive contact stress at said selected depth.

2. The method as set forth in claim 1 wherein the liquid element is a cement slurry which hardens over time and incurs a volume contraction.

3. The method as set forth in claim 1 wherein said elastic strain analysis is limited to radial stress and radial displacement of said layers.

4. The method as set forth in claim 1 wherein the depth in said wellbore is in a larger diameter bore located below a smaller diameter bore and the packer is run through the smaller diameter bore and inflated in the larger diameter bore.

5. A method for determining the inflation pressure for an elongated inflatable packer to effect a seal with a borehole wall in a wellbore traversing earth formations where the wellbore has a disturbed temperature condition relative to a quiescent temperature condition and where such packer has a central tubular mandrel and the elastomer packer element is mounted on said mandrel in sleeved relation thereto and where said packer element is subject to inflation by a infinite inflation pressure of a liquid element to produce a radial expansion of said packer element so that a final positive contact stress is obtained between the packer element and the borehole wall, where said final positive contact stress enables the packer element to provide a seal with respect to the borehole wall, and where said mandrel, said packer element and said liquid element are radial layers of elements extending from the borehole centerline to the borehole wall, said method including the steps of:

selecting a depth in said wellbore for inflation of said packer element;

determining the final positive contact stress on a borehole wall from aximetric plane strain equations for radial stress and radial displacement in a radial plane by matching common stress values at interfaces of said layers for each interface of said layers and utilizing the temperature differential and inflation pressure for the packer element with established physical parameters for strain and displacement of said elements;

adjusting the thickness of the packer element to obtain said final contact stress with respect to the borehole wall so that said final contact stress is a positive value; and running the packer into the wellbore and inflating the packer element at said selected depth with the said inflation pressure required to obtain said final positive contact stress of the packer element at said selected depth.

6. The method as set forth in claim 5 wherein the depth in said wellbore is in a larger diameter bore located below a smaller diameter bore and the packer is run through the smaller diameter bore and inflated in the larger diameter bore.

7. The method as set forth in claim 5 wherein the liquid element is a cement slurry which hardens over time and incurs a volume contraction.

8. A method for determining the inflation pressure for an elongated inflatable packer to effect a positive seal of an elastomer packer element with a borehole wall in a wellbore traversing earth formations where the wellbore has a disturbed temperature condition relative to a quiescent temperature condition and where such packer has a central tubular mandrel and the elastomer packer element is mounted on said mandrel in sleeved relation thereto and where said packer element is subject to inflation by a finite inflation pressure of a liquid element to produce a radial expansion of said packer element so that a final positive contact stress is obtained between the packer element and the borehole wall and where the positive contact stress enables the packer element to provide a seal with respect to the borehole wall, and where said mandrel, said packer element and said liquid element are layers of elements extending in a radial direction from a borehole centerline to the borehole wall, said method including the steps of:

selecting a depth in said wellbore for inflation of said packer element;

determining the final positive contact stress on a borehole wall from aximetric plane strain equations for radial stress and radial displacement of said layers in a radial plane through said layers and surrounding earth formations by matching common stress values at interfaces of said layers for each interface between layers including the outermost layer with said earth formation and utilizing the temperature differential and inflation pressure for the packer element;

for each layer, adjusting the temperature differential between its disturbed and quiescent temperature conditions to adjust the disturbed temperature condition to an adjusted temperature value to the final positive contact stress value with respect to the borehole wall so that the final contact stress is a positive value; and running the packer into the wellbore and inflating the packer element to the inflation pressure at said selected depth while maintaining said adjusted temperature value in said packer so that the final positive value of contact stress is obtained when said adjusted temperature value is returned to a quiescent temperature condition.

9. The method as set forth in claim 8 wherein the depth in said wellbore is in a larger diameter bore located below a smaller diameter bore and the packer is run through the smaller diameter bore and inflated in the larger diameter bores.

10. The method as set forth in claim 9 wherein the liquid element is a cement slurry which hardens over time and incurs a volume contraction.

11. The method as set forth in claim 8 wherein the liquid element is a drilling mud which hardens over time and undergoes volume contraction.

12. A method for determining the inflation pressure for an elongated inflatable packer to effect a positive seal of an elastomer packer element with a borehole wall in a wellbore traversing earth formations, where the wellbore has a disturbed temperature condition relative to a quiescent temperature condition at the location where the packer will be inflated, and where said packer element has a central tubular mandrel and the elastomer packer element has a certain wall thickness and is mounted on said mandrel in sleeved relation thereto, and where said packer element is subject to inflation by as finite inflation pressure of a liquid element liquid pressure to produce a radial expansion of said packer element and so that a final positive contact stress can be obtained between the packer element and the borehole wall, and where the final positive contact stress enables the packer element to provide a seal with respect to the borehole wall, and where said mandrel, said packer element and said liquid element are radial layers of elements extending from a borehole centerline to the borehole wall, said method including the steps of:

selecting a depth in said wellbore for inflation of said packer element;

determining, for each layer at the location, the undisturbed temperature conditions in a radial plane through said layers and the surrounding earth formations for each layer and the earth formations;

for the desired final positive contact stress, determining the temperature differentials in an elastic strain analysis for a radial plane in respect to the layers of such tubular mandrel, said liquid packer element, and the earth formations in said horizontal plane, the finite inflation pressure and the certain wall thickness to required obtain said desired final positive contact stress; and running the packer into the wellbore to the selected depth, and then inflating the packer element with said liquid element at said selected depth at the finite inflation pressure required and at the temperature differential required to obtain the desired final positive contact stress at said selected depth.

13. The method as set forth in claim 11 wherein the location in said wellbore in a larger diameter bore located below a smaller diameter bore and the packer is run through the smaller diameter bore and inflated in the larger diameter bore.

14. The method as set forth in claim 13 wherein the liquid element is a cement slurry which hardens over time and incurs a volume contraction.

15. The method as set forth in claim 14 wherein said temperature differential is obtained by reducing the temperature of the liquid element.

16. A method for determining the inflation pressure for an elongated inflatable packer to effect a positive seal of an elastomer packer element with a borehole wall in a wellbore traversing earth formations where the wellbore has a disturbed temperature condition relative to a quiescent temperature condition and where such packer has a central tubular mandrel and the elastomer packer element is mounted on said mandrel in sleeved relation thereto and where said packer element is subject to inflation by a finite inflation pressure of a liquid element from a source of liquid pressure to produce a radial expansion of said packer element and so that a value of a final contact stress with to the borehole wall and the packer element can be obtained and where a final contact stress with a positive value enables the packer element to provide a seal with respect to the borehole wall, and where said mandrel, said packer element and said liquid element are radial layers of elements extending from a borehole centerline to the borehole wall, said method including the steps of:

selecting a depth in said wellbore for inflation of said packer element;

determining, for each layer at said depth, the temperature differential in a radial plane through said layers and surrounding earth formations between the temperature for each layer and the earth formations at a disturbed temperature condition in the wellbore and the quiescent temperature of each layer and the earth formation in undisturbed temperature conditions;

determining the value of the final contact stress with respect to the borehole wall and the packer element from aximetric plane strain equations for radial stress and radial displacement in a radial plane by matching common stress values at interfaces of said layers for each interface of said layers and utilizing the temperature differential and a value for the finite inflation pressure for the packer element with established physical parameters for strain and displacement of said layers.

17. The method as set forth in claim 16 and further including the step of adjusting the thickness of the wall of the packer element in the determining of the final contact stress with the aximetric plane strain equations to obtain a final contact stress with respect to the borehole wall which is a positive value.

18. The method as set forth in claim 16 and further including the step of adjusting the temperature differential between the disturbed and quiescent temperature conditions in the determining of the final contact stress with the aximetric plane strain equations to obtain a final contact stress with respect to the borehole wall which is a positive value.

19. The method as set forth in claim 16 and further including the step of adjusting the temperature differential between the disturbed and quiescent temperature conditions in the determining of the final contact stress with the aximetric plane strain equations to obtain a final contact stress with respect to the borehole wall which is a positive value.

* * * * *